US007321301B2

(12) United States Patent
Spoltore et al.

(10) Patent No.: US 7,321,301 B2
(45) Date of Patent: Jan. 22, 2008

(54) WIRELESS CHILDREN'S SAFETY LIGHT IN A SECURITY SYSTEM

(75) Inventors: Michael T. Spoltore, Valley Stream, NY (US); Robert S. Adonailo, Rockville Centre, NY (US); Robert J. Orlando, Nesconset, NY (US); Alfred M. Lizza, Oyster Bay, NY (US); Scott Simon, Melville, NY (US)

(73) Assignee: Honeywell International, Inc., Morristown, NJ (US)

( * ) Notice: Subject to any disclaimer, the term of this patent is extended or adjusted under 35 U.S.C. 154(b) by 0 days.

(21) Appl. No.: 10/677,507

(22) Filed: Oct. 2, 2003

(65) Prior Publication Data

US 2005/0073405 A1 Apr. 7, 2005

(51) Int. Cl.
*G08B 1/08* (2006.01)

(52) U.S. Cl. ..... 340/539.22; 340/577; 340/545.1; 340/286.05; 362/554; 362/559; 362/802; 439/490

(58) Field of Classification Search ..... 340/539.22, 340/539.31, 545.1, 555, 628, 577, 332, 286.05; 362/554, 559, 802; 439/490
See application file for complete search history.

(56) References Cited

U.S. PATENT DOCUMENTS 4,531,114 A * 7/1985 Topol et al. ..... 340/539.1
4,763,115 A * 8/1988 Cota ..... 340/628
4,796,018 A * 1/1989 Nakanishi et al. ..... 340/691.1
4,967,317 A * 10/1990 Plumly ..... 362/613
5,177,461 A 1/1993 Budznya et al.
5,325,279 A 6/1994 Freelove et al.
5,594,428 A * 1/1997 Peterson ..... 340/825.36
5,745,040 A 4/1998 Loughridge
5,825,280 A * 10/1998 Merendini et al. ..... 340/326
6,000,505 A * 12/1999 Allen ..... 187/391
6,114,948 A * 9/2000 Astell ..... 340/332
6,157,298 A * 12/2000 Garfinkel et al. ..... 340/479
6,222,455 B1 * 4/2001 Kaiser ..... 340/628
6,249,221 B1 * 6/2001 Reed ..... 340/539.14

(Continued)

OTHER PUBLICATIONS

TOT finder decals help alert firemen to child's room Jul. 31, 2003.*

(Continued)

*Primary Examiner*—Benjamin C. Lee
*Assistant Examiner*—Daniel Previl
(74) *Attorney, Agent, or Firm*—Scully, Scott, Murphy & Presser, P.C.

(57) ABSTRACT

A safety light is activated by a wireless signal from a control panel in a home security system is response to detection of a fire by the system. The safety light alerts rescuers of rooms in a home in which children may be located. The light may be window, door or wall-mounted, and have a single, or dual opposing, backlit faces. The backlit face includes a logo and/or text that is quickly recognized by rescuers. For example, a logo of a firefighter carrying a baby may be used with the text "tot rescue". The safety light may communicate status information to the control panel, such as a low battery condition or a tamper alert. A tamper alert switch detects tampering with the housing of the safety light or its installation. Additional safety lights provide ambient illumination and directional information to an exit.

25 Claims, 7 Drawing Sheets

U.S. PATENT DOCUMENTS 6,310,539 B1 * 10/2001 Rye et al. ..... 340/321
6,384,724 B1 * 5/2002 Landais ..... 340/531
6,459,370 B1 * 10/2002 Barrieau et al. ..... 340/514
6,529,230 B1 * 3/2003 Chong ..... 348/14.01
6,646,545 B2 * 11/2003 Bligh ..... 340/286.05
6,720,874 B2 * 4/2004 Fufido et al. ..... 340/541
6,737,962 B2 * 5/2004 Mayor ..... 340/431
6,741,324 B1 * 5/2004 Kim, II ..... 362/249
6,766,983 B2 * 7/2004 D'Alvia ..... 244/118.5
6,956,478 B2 * 10/2005 Oyagi et al. ..... 340/541
7,019,639 B2 * 3/2006 Stilp ..... 340/531

OTHER PUBLICATIONS

"Tot Finder Decals Help Alert Firemen to Child's Room", www.perfectlysafe.com/totfindec2pk.html, printed Jul. 31, 2003.

* cited by examiner

WIRELESS CHILDREN'S SAFETY LIGHT IN A SECURITY SYSTEM

BACKGROUND OF THE INVENTION

1. Field of Invention

The invention relates generally to a children's safety light that may be used with a home security system.

2. Description of Related Art

Fire safety in the home is an important issue that has received much attention. Smoke detectors have been designed to inform occupants of the home that a fire has broken out. The smoke detector is typically a standalone device mounted to the ceiling that sounds an audible alarm that alerts nearby occupants of the emergency condition. Centrally monitored smoke detectors have also been used. Moreover, some smoke detectors have a built in light that illuminates the room when the alarm is sounded. While it is preferable for the occupants to leave the home when a fire is detected, sometimes this is not possible, and the occupants must be rescued by rescue personnel such as local fire fighters. Accordingly, various approaches have been developed to signal the location of the occupants in the home to the rescue personnel. One popular approach has been to apply reflective "tot finder" decals to the bedroom windows of the home where children or other occupants normally sleep. The decal may also be placed near the bottom of a bedroom door facing a hallway, for example, where visibility is likely to be best in a fire. The decal is visible to the rescue personnel from outside or inside the home and may expedite a search for occupants in the particular bedroom. While such decals can be helpful, they may not command sufficient attention to serve the purpose of alerting rescue personnel. For example, visibility of the decals may be reduced by the presence of smoke or other factors. Moreover, visibility of the decals at night is not high unless a flashlight or other light is shone on them.

BRIEF SUMMARY OF THE INVENTION

To overcome these and other deficiencies in the prior art, the present invention describes a safety light that may be used with a home security system.

In one aspect of the invention, a security system with a safety light feature includes a control for controlling the security system, at least one sensor adapted to provide a signal to the control indicating that an emergency condition has been detected, at least one safety light comprising a receiver for receiving a wireless signal, and a transmitter responsive to the control for transmitting a wireless signal to the at least one safety light to activate the at least one safety light when the control receives the signal indicating that the emergency condition has been detected.

In another aspect of the invention, a safety light includes a housing, including at least a first face, a receiver for receiving a wireless activation signal from a transmitter in a home security system when a sensor in the home security system has detected an emergency condition, and a control responsive to the receiver for providing an illuminated indicia on the first face for informing rescue personnel of the emergency condition when the wireless activation signal is received by the receiver.

An illuminating safety light for providing ambient lighting, and a directional safety light having directional indicia such as arrows for indicating the direction of an exit in a building, are also provided.

BRIEF DESCRIPTION OF THE DRAWINGS

These and other features, benefits and advantages of the present invention will become apparent by reference to the following text and figures, with like reference numbers referring to like structures across the views, wherein.

DETAILED DESCRIPTION OF THE INVENTION

Figure 1:
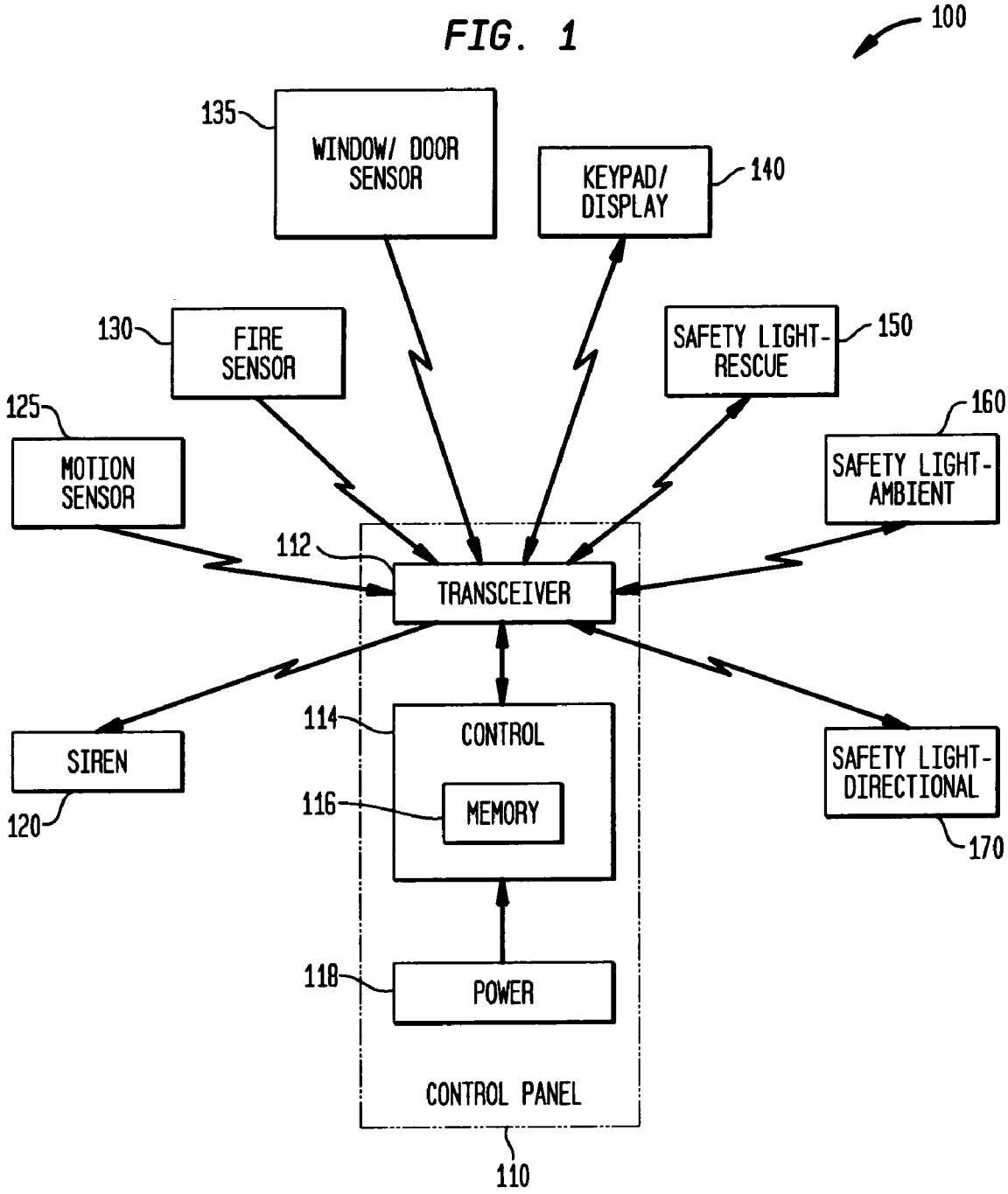
FIG. 1 illustrates an overview of a security system with safety lights according to the invention.

FIG. 1 illustrates an overview of a security system with safety lights according to the invention. Many homes and small businesses today are equipped with security systems to deter burglaries and detect fires. The term "security" thus encompasses security from intrusion as well as fire. Other hazards such as carbon monoxide may also be monitored. A typical security system 100 includes a central control panel 110 that communicates with a number of sensors via a wired or wireless path. For example, the control panel 110 may receive signals from motion sensors 125 that detect when a person enters a room. Signals received from fire sensors 130, such as smoke or heat sensors, indicate that a fire has been detected. Typically, a number of fire sensors 130 are provided in different rooms and floors of a home. Signals received from window and door sensors 135 indicate that a window or door has been opened. Signals received from a peripheral keypad/display 140 may arm and disarm the system, as well as trip an alarm via a panic button feature. A wireless key fob may also be used to trip an alarm. The control panel 110 may also transmit signals to various components of the system 100. For example, signals may be transmitted to a siren 120 to activate the siren when an alarm condition is detected. Signals may be sent to the keypad/display 140 to display status information to the user, such as whether the system is armed or disarmed, or whether a specific door or window has been opened. The control panel 10 may also have the ability to notify local emergency services of an alarm condition via telephone.

To facilitate installation and avoid the need to install wiring in a home, wireless security system components may be employed. Some components only transmit or receive. For example, the motion sensors 125, fire sensors 130, and window and door sensors 135 typically only transmit back to the control panel 110 when they are tripped, while the siren 120 only receives a signal from the control panel 110 when the control panel 110 detects an alarm condition based on a signal received from one of the sensors. The peripheral keypad/display 140 may have both transmit and receive capabilities to communicate with the control panel 110. The wireless security system components may use radio frequency (RF) signals. One system uses signals at 345 MHz to provide a nominal indoor range of 200 feet. Different manufacturers may use different proprietary schemes for communicating data. For example, different coding and modulation techniques may be used. Components provided by Honeywell Corp. may advantageously be used.

The control panel 110 includes a transceiver (transmitter and receiver) 112 for transmitting and receiving wireless signals. A control 114 with associated memory 116 includes a microprocessor that may execute software or firmware to achieve the desired functionality of the security system. A dedicated chip such as an ASIC may also be used. Generally, each wireless component of the security system must be "learned" by the control 114. In the learning process, data is stored in the non-volatile memory 116 that identifies the characteristics of each sensor, including the sensor type, serial number, and what type of action to take based on signals received from each sensor. For example, the action may be to provide a status message to the user, store data for subsequent maintenance purposes, or trip an alarm. A power source 118 provides power to the control panel 110 and typically includes a battery backup to AC power.

The present inventors have determined that a number of different types of wireless safety lights can be incorporated into an existing security system. That is, the lights can be implemented with the existing wireless communication components and transmitting and receiving protocols of the control panel 110. Accordingly, the lights can be easily incorporated into new control panel designs. The safety lights can be provided in different locations in the home and activated by a wireless activation signal from the control panel 110. Since the control panel 110 receives signals (wired or wireless) from different sensors in the home, the safety lights can advantageously be activated to optimally address an emergency condition in the home. The different safety lights that may be provided according to the invention include a rescue alert light, an ambient light, and a directional light for indicating the direction of an exit.

Figure 2:
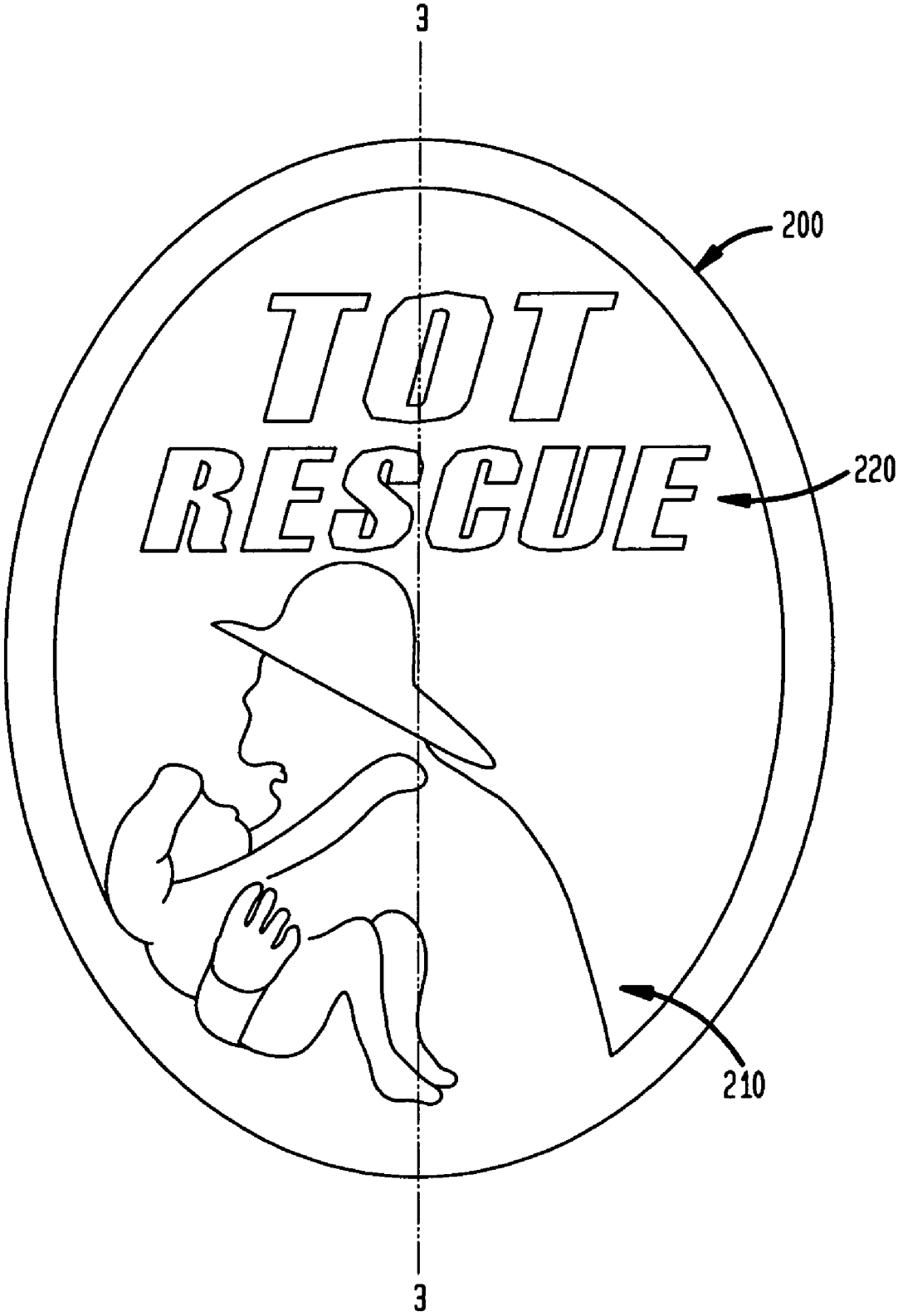
FIG. 2 illustrates a front view of a rescue alert safety light with a logo of a fireman and a baby.

FIG. 2 illustrates a front view of a rescue alert safety light 200 with a logo 210 of a fireman and a baby. The safety light also includes the text 220 "tot rescue" informing rescue personnel that a child may need to be rescued from the room. The particular design shown is generally recognizable to many fire fighters for this purpose. However, essentially any text and/or logo may be used to alert rescuers. For example, text such as "bedroom," "rescue child", "senior", "invalid" and so forth may be used. Moreover, while an oval shape is shown, other shapes may also be used. The logo should be generally recognizable and understood to be a rescue alert indicia. A number of the safety lights 200 may be used in various places in the home. For example, the safety light 200 may be mounted to the bedroom windows so that they are visible from outside the home. The safety light 200 may also be mounted on or near a bedroom door on the side of the door that faces an interior hallway of the home. A location near the floor is believed to be desirable since smoke rises. Advantageously, each safety light 200 can be activated immediately by the control panel 110 of the security system 100 when a fire is detected by a smoke alarm anywhere in the home.

Figure 3:
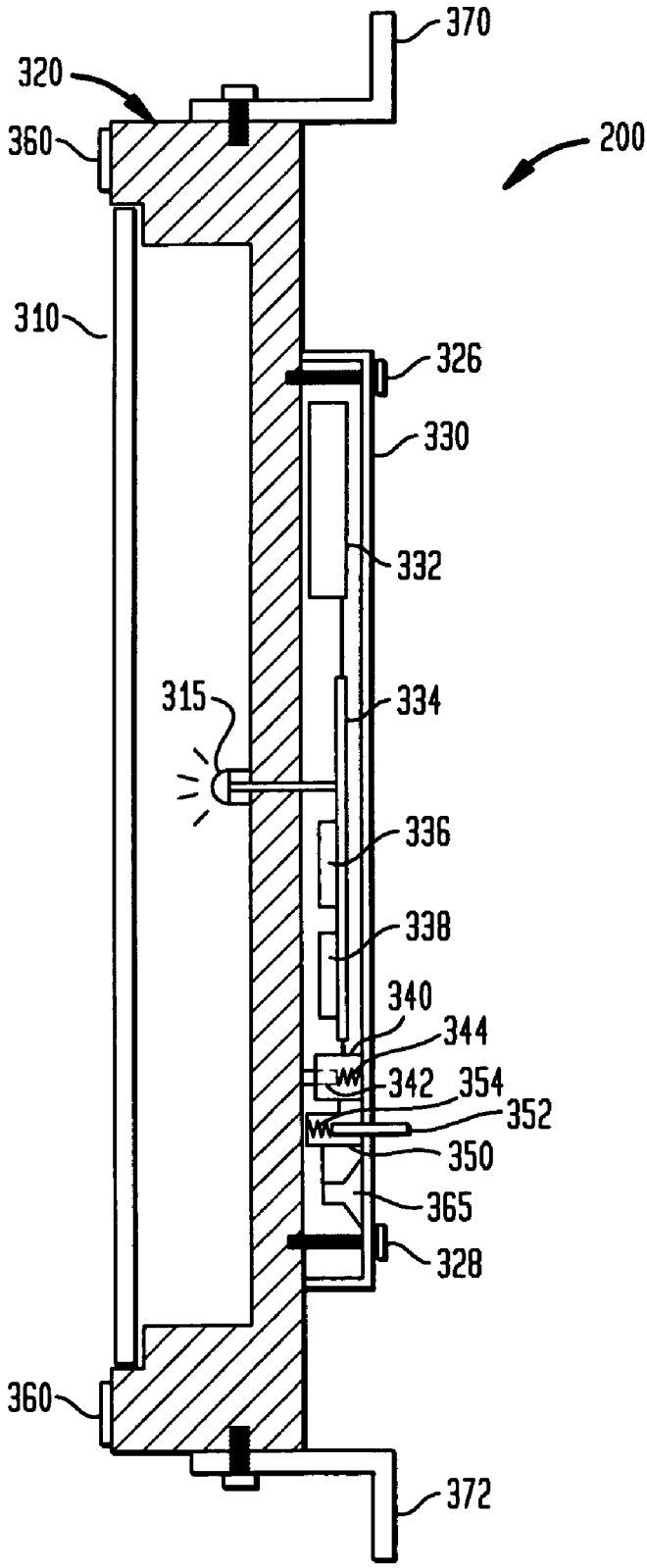
FIG. 3 illustrates a cross-sectional view of the safety light of FIG. 2 with one backlit face.

FIG. 3 illustrates a cross-sectional view of the safety light 200 of FIG. 2 with one backlit face 310. When the safety light 200 is mounted against a flat surface such as a door or wall, only one side of the safety light 200 need be illuminated. The face 310 may be made of clear or otherwise light-transmissive plastic with a decal applied that has the desired design on it, such as the design of FIG. 2. Or, the design may be provided in the face 310 such as by impregnating a plastic panel with different colors. The face 310 is backlit by a light bulb 315, which may be a single bulb or represented a number of bulbs or light-emitting sources such as high intensity light-emitting diodes (LEDs). The bulb 315 is flashed on and off to provide a strobe light effect. The face 310 is secured to a housing 320 of the safety light 200 using an adhesive or other appropriate mounting technique and thus becomes part of the housing 320. The housing 320 surrounds the face 310 and includes a number of components for activating the bulb 315 and for communicating with the control panel 110 of the security system 100. Optionally, backlighting is not used but an illuminated rescue indicia is provided directly, e.g., by controlling pixel elements in a grid of pixels on the face 310.

Figure 5:
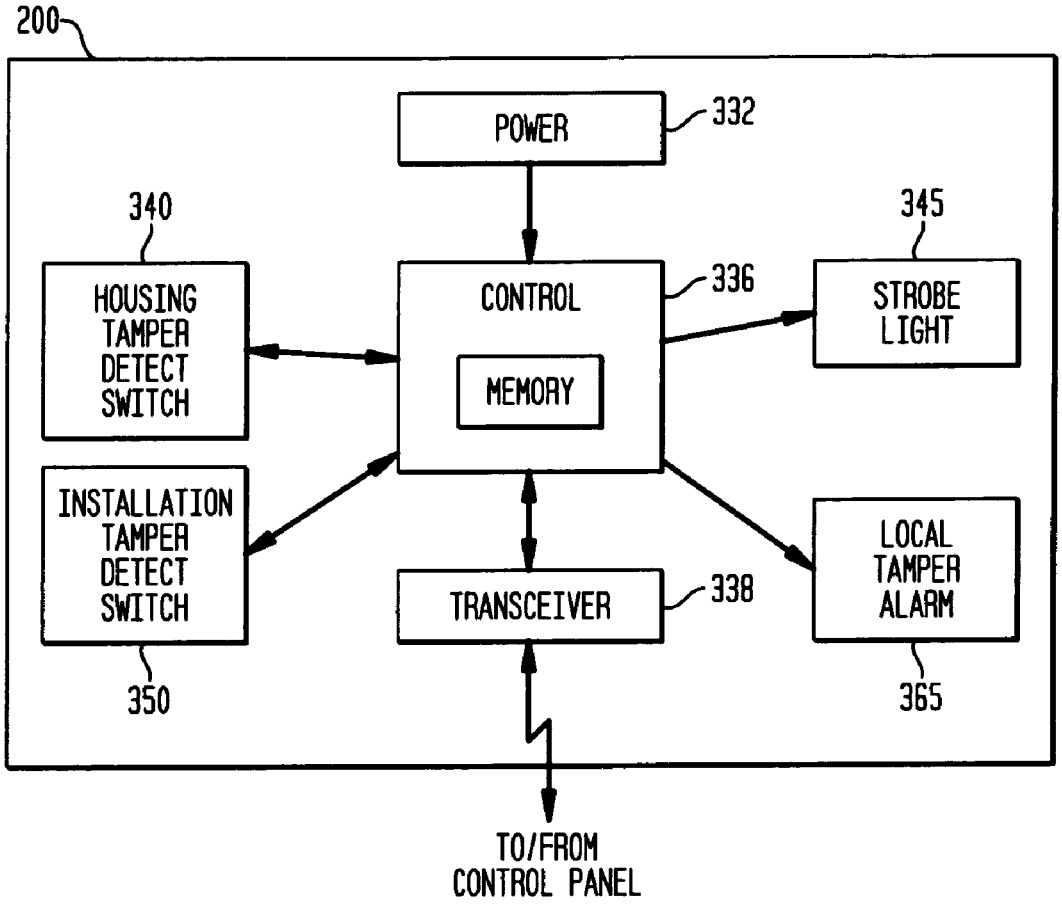
FIG. 5 illustrates a block diagram of the safety light of FIG. 3.

In particular, a back cover 330 of the housing 320 may be removed, such as by removing fasteners 326 and 328, to expose a battery 332 and a printed circuit board 334 on which a control/memory 336, and transceiver 338, are provided. Refer also to FIG. 5. The battery 332 may be a CR123A 3-Volt Lithium battery, for example, or one or more size AA or AAA batteries. The bulb 315 communicates with the printed circuit board 334 via appropriate wiring to receive a power signal from the battery 332. Optionally, an AC power supply may be used as a primary power source while the battery 332 is used for backup only. A first tamper detect switch 340 detects when the cover 330 has been removed, e.g., when the housing 320 has been tampered with. The switch 340 may include a plunger 342 that is spring biased by a spring 344 such that the plunger 342 extends from the switch 340 when the cover 330 is removed. The extension of the plunger 342 closes the switch 340 and sends a tamper signal to the control/memory 336. In response, the control/memory 336 may activate an audible alarm 365 at the safety light 200. A corresponding tamper signal may also be provided to the control panel 110 via the transceiver 338.

Similarly, a second tamper detect switch 350 detects when the installation of the housing 320 has been compromised. The switch 350 may include a plunger 352 that is spring biased by a spring 354 such that the plunger extends from the switch 350 and from the housing 320 when the safety light 200 is not installed. However, when the safety light 200 is installed against a flat surface such as a wall or door, e.g., using brackets 370 and 372, the plunger 352 is at least partly withdrawn into the switch 350. When the safety light 200 is subsequently removed or dislodged from its position against the wall or door, the plunger 352 extends, thereby closing the switch 350 and sending a tamper signal to the control/memory 336. In response, the control/memory 336 may activate the audible alarm 365 and/or send a corresponding tamper signal to the control panel 110.

If the safety light 200 is installed against a window, such as by using a ring 360 of double-sided adhesive around the perimeter of the face 310, the switch 350 is not used, and may be bypassed such as by taping over the plunger 352. Or, a mechanism on the printed circuit board 334 such as a DIP switch may be used to inactivate the switch 350. The switch 340 that detects tampering with the housing 320 may similarly be inactivated if desired. The brackets 370 and 372 may also be removed if not needed.

The transceiver 338 enables the safety light 200 to communicate with the control panel 110 of the security system 100. In particular, as mentioned, the control panel 110 may activate the safety light 200 to flash the bulb 315 when a fire or other emergency is detected by the fire detection sensor 130. In one approach, the control panel 110 transmits a separate wireless activation signal to each safety light using the light's unique identifier such as serial number. In another approach, components of a common type, such as all safety lights of the same type (e.g., rescue alert, ambient lighting, or directional), may be addressed by a common identifier. In another possibility, the control panel 110 sends a signal to the safety light 200 to command the audible alarm 365 to sound to provide an alert to the occupants of the fire condition. A second audible alarm in the room such as the alarm in a smoke detector may be similarly command by the control panel 110 to sound.

Optionally, the safety light 200 may also communicate status information to the control panel 110. If this feature is not needed, the cost of the safety light can be reduced by using a receiver in place of a transceiver since no transmitter is needed. Regarding the status information, the control/memory 336 may monitor the battery 332 and the AC power level, when used, to detect a low battery or loss of power condition, and to provide a corresponding status signal. The status information may also indicate whether the housing 320 has been tampered with or its installation has been compromised. The control panel 110 may set an audible and/or visible alarm, such as at the peripheral keypad/display 140, based on the status information provided by the safety light to inform the user to check the safety light.

Figure 4:
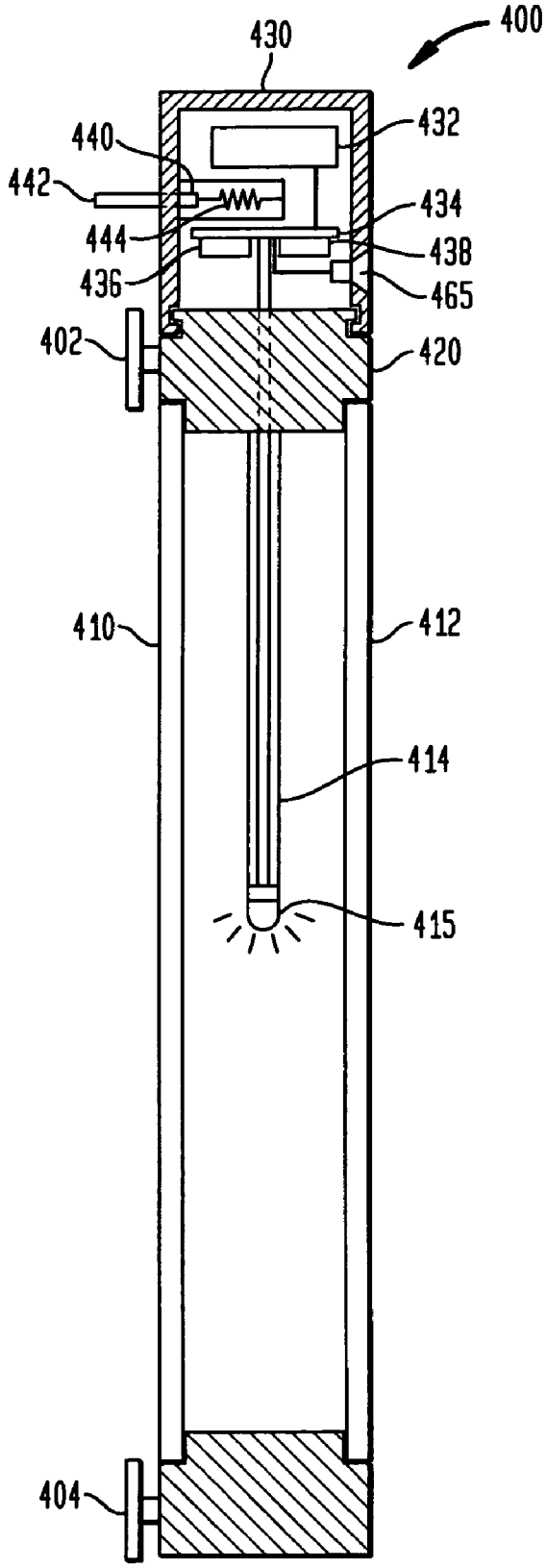
FIG. 4 illustrates a cross-sectional view of a safety light with opposing backlit faces.

FIG. 4 illustrates a cross-sectional view of a safety light 400 with opposing backlit faces 410 and 415. This design may be advantageous when the safety light 400 is window-mounted, for example, using suction cups 402 and 404, or adhesive tape. In this case, a first face 410 is visible from outside the home, while the second face 415 is visible from inside the home. The second face 415 can alert a rescuer, who is searching the home room by room that a child or other person may be in a particular room. The faces 410 and 412 are backlit by a light bulb 415, and may be secured to a housing 420 of the safety light 400 using an adhesive or other appropriate technique. As with the housing 320 of FIG. 3 the housing 420 surrounds the faces 410 and 412 and includes a number of components for activating the bulb 415 and for communicating with the control panel 110 of the security system 100. Since two faces are used, the components may be placed in a peripheral location of the housing 420, such as at the top of the housing 420. Alternatively, the housing 430 may be divided into two separate compartments for each face 410 and 412, where the components are provided between the compartments.

A snap fit cover 430 of the housing 420 may be removed to expose a battery 432 and a printed circuit board 434 on which a control/memory 436 and transceiver 438 are provided. The bulb 415, which is mounted centrally in the housing 420 using a mounting arm 414 that extends radially in the housing 420, communicates with the printed circuit board 434 via appropriate wiring to receive a power signal from the battery 432 and/or AC power supply. A tamper detect switch 440 detects when the safety light 400 has been removed from the window, e.g., when the installation of the housing 420 has been compromised. The switch 440 may include a plunger 442 that is spring biased by a spring 444 such that the plunger 442 extends from the switch 440 when the safety light 400 has not yet been installed. When the safety light 400 is installed against the window the plunger 442 is at least partly withdrawn into the switch 440. If the safety light 400 is subsequently removed from the window, the plunger 442 extends and closes the switch 440, sending a tamper signal to the control/memory 436. In response, the control/memory 436 may activate an audible alarm 465, and communicate a corresponding tamper signal to the control panel 110.

The transceiver 438 enables the safety light 400 to communicate with the control panel 110 of the security system 100. In particular, as mentioned, the control panel 110 may activate the safety light 400 when a fire condition is detected, while the safety light 400 may communicate status information to the control panel 110. Note that while one bulb 415 may be used to backlight the two faces 410 and 412, it is also possible to use a separate bulb for each face 410 and 412, e.g., so that each face can be illuminated at a different flash rate, intensity, or using a different colored bulb, for instance. A light-blocking barrier between the two faces 410 and 412 may be used in this situation.

FIG. 5 illustrates a block diagram of the safety light 200 of FIG. 3. The safety light 200 includes a control with memory 336, a power source 332 such as a battery, a strobe light 315, a local tamper alarm 365, and a transceiver 338 for communicating the control panel 110 via wireless signals. The safety light 200 may also include a housing tamper detect switch 340 and an installation tamper detect switch 350. See the discussion of FIG. 3 for further details.

Figure 6:
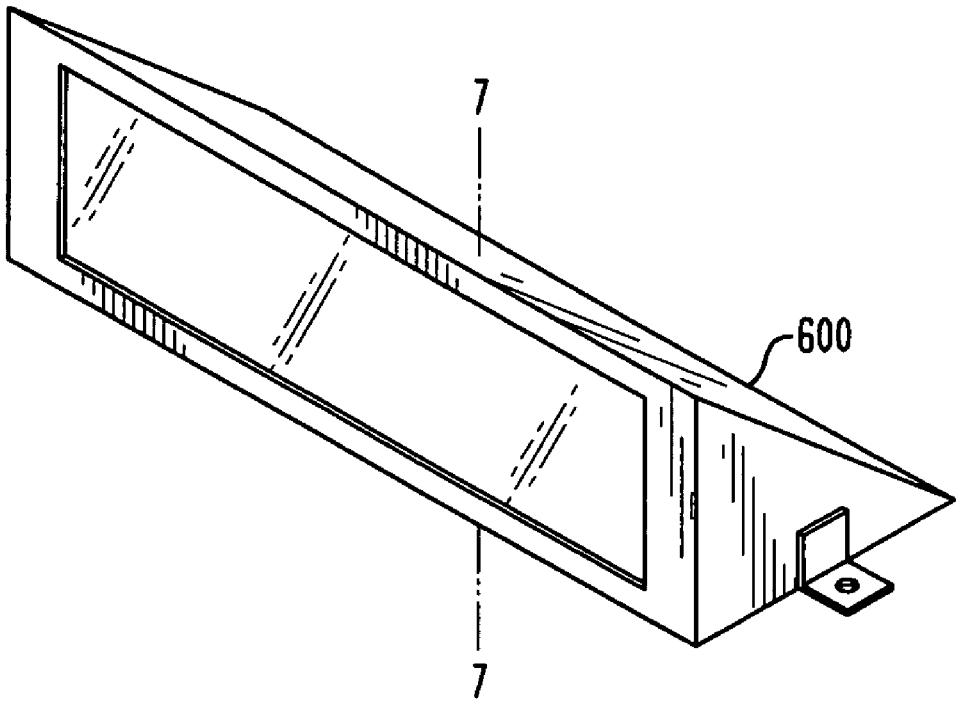
FIG. 6 illustrates a perspective view of a safety light that provides ambient lighting.
Figure 7:
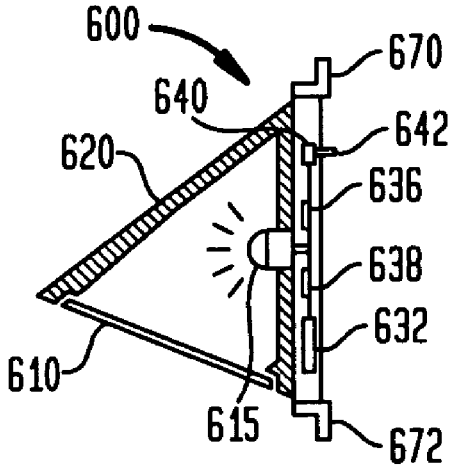
FIG. 7 illustrates a cross-sectional view of the safety light of FIG. 6.

FIG. 6 illustrates a perspective view of a safety light 600 that provides ambient lighting in a room when a fire condition has been sensed by the control panel 110 of the security system 100. This is advantageous since it assists the occupant in exiting the room and avoiding tripping over obstacles. Moreover, the safety light 600 may be activated when emergency conditions other than fire are detected, including loss of power to the home, unauthorized entry, excess carbon monoxide or other gaseous substances, and so forth. FIG. 7 illustrates a cross-sectional view of the safety light of FIG. 6. The safety light 600 includes a housing 620 with a light transmissive face 610, and mounting brackets 670 and 672 for securing the safety light 600 to a wall, e.g., above a door or other location where ambient lighting is desired. The components provided in the safety light 600 are analogous to those provided in the safety light 200, except that a continuously burning bulb 615 is used. A fluorescent bulb may be used, for example, or high-intensity LEDs. A control/memory 636, transceiver 638 and battery 632 provide the functions as discussed previously in turning on the bulb 615 in response to a command from the control panel 110, and communicating status information to the control panel. A tamper switch 640 with plunger 642 detects when the installation of the housing 600 has been compromised since the plunger 642 is pressed in to the switch 640 when the housing 600 is mounted to a flat surface such as a wall. If the housing 600 is subsequently removed from the wall, the plunger extends, thereby closing the switch 640 and causing a tamper alert. A local audible alarm, not shown, may also be provided.

Figure 8:
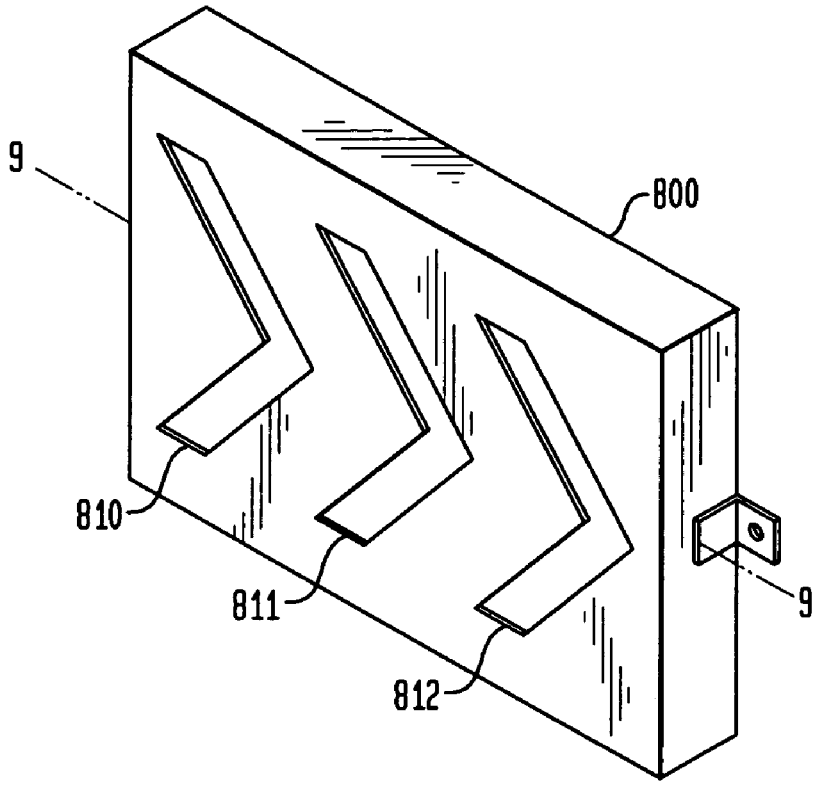
FIG. 8 illustrates a perspective view of a safety light that provides directional indicia.
Figure 9:
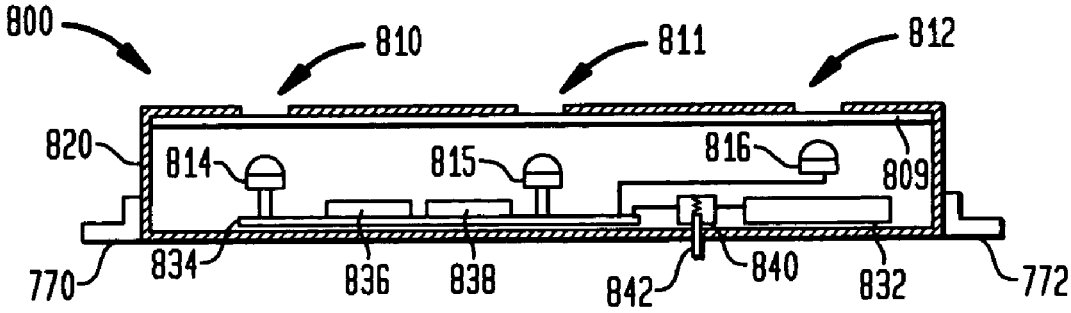
FIG. 9 illustrates a cross-sectional view of the safety light of FIG. 8.

FIG. 8 illustrates a perspective view of a safety light 800 that provides directional indicia such as arrows 810, 811 and 812. This type of safety light can be used in a home or other building to direct an occupant to an exit during an emergency condition. FIG. 9 illustrates a cross-sectional view of the safety light of FIG. 8. The safety light 800 includes a housing 820 with light transmissive faces 810, 811 and 812 that form the directional indicia, and mounting brackets 770 and 772 for securing the safety light 800 to a wall, such as near the floor. The components provided in the safety light 800 are analogous to those provided in the safety light 200, except that separate bulbs or light emitters 814, 815 and 816 may be used to backlight the indicia 810, 811 and 812, respectively. A control/memory 836, transceiver 838 and battery 832 provide the functions as discussed previously in turning on the bulbs 814, 815 and 816 in response to a command from the control panel 110, and communicating status information to the control panel. In particular, the bulbs 814, 815 and 816 may be activated so that they backlight a corresponding one of the directional indicia, one at a time, in a time sequence. In this case, a light-blocking barrier may be used between the bulbs 814, 815 and 816 within the housing 820. Or, a single bulb or light-emitting element may be used to illuminate all indicia 810, 811 and 812 concurrently. When a number of safety lights 800 are used to lead an occupant to an exit, the safety lights may be activated in a particular sequence, e.g., so that the safety light farthest from the exit is activated first, then the safety light that is the next closest is activated, and so forth. The control panel 110 is programmed with timing information to command each safety light at the appropriate time.

A tamper switch 840 with plunger 842 may be used to detect when the installation of the housing 800 has been compromised since the plunger 842 is pressed in to the switch 840 when the housing 800 is mounted to a flat surface such as a wall. If the housing 800 is subsequently removed from the wall, the plunger 842 extends, thereby closing the switch 840 and causing a tamper alert. A local audible alarm, not shown, may also be provided.

Note that any of the safety lights may be activated based on the detection of an emergency condition which is not necessarily a fire.

The invention has been described herein with reference to particular exemplary embodiments. Certain alterations and modifications may be apparent to those skilled in the art, without departing from the scope of the invention. The exemplary embodiments are meant to be illustrative, not limiting of the scope of the invention, which is defined by the appended claims.

What is claimed is:

1. A security system with a safety light feature, comprising:

a control for controlling the security system;

wherein the security system secures a building against burglaries;

at least one sensor providing a signal to the control indicating that an emergency condition has been detected;

at least one safety light, mountable at a remote location relative to a designated emergency exit, the at least one safety light comprising:

at least one of a rescue alert light and a directional light for indicating a direction to the designated emergency exit;

a housing;

a receiver provided within the housing for receiving a wireless signal; and a transmitter provided within the housing for transmitting a wireless signal to a receiver in the home security system to inform the home security system of a status of the safety light; and a transmitter responsive to the control for transmitting a wireless signal to the at least one safety light to activate the at least one safety light when the control receives the signal indicating that the emergency condition has been detected.

2. The security system of claim 1, wherein: the transmitter is adapted to transmit a wireless signal to at least one security system component in the security system;

wherein the at least one security system component is used in the security system for securing the building against burglaries.

3. The security system of claim 1, further comprising: a plurality of sensors providing signals to the control indicating that the emergency condition has been detected;

wherein the transmitter transmits a wireless signal to the at least one safety light to activate the at least one safety light when the control receives the signal from any one of the fire detection sensors indicating that the emergency condition has been detected.

4. The security system of claim 1, further comprising: a plurality of safety lights comprising respective receivers for receiving wireless signals;

wherein the transmitter transmits wireless signals to the plurality of safety lights to activate the plurality of safety lights when the control receives the signal indicating that an emergency condition has been detected.

5. The security system of claim 1, wherein: the at least one safety light comprises indicia for informing rescue personnel of the emergency condition.

6. The security system of claim 5, wherein: the indicia comprises an image of a firefighter and a child.

7. The security system of claim 1, wherein: the emergency condition comprises a fire.

8. The security system of claim 1, wherein: the safety light comprises an ambient light.

9. The security system of claim 1, wherein: the safety light comprises a directional light to indicate a direction of an exit from the building.

10. A safety light, comprising:

a housing, including at least a first face, the safety light being mountable at a remote location relative to a designated emergency exit;

at least one of a rescue alert light and a directional light for indicating a direction to the designated emergency exit;

a receiver for receiving a wireless activation signal from a transmitter in a home security system when a sensor in the home security system has detected an emergency condition;

a transmitter provided within the housing for transmitting a wireless signal to a receiver in the home security system to inform the home security system of a status of the safety light;

wherein the home security system secures a building against burglaries; and a control responsive to the receiver for providing an illuminated indicia on the first face for informing rescue personnel of the emergency condition when the wireless activation signal is received by the receiver.

11. The safety light of claim 10, wherein: the emergency condition comprises a fire.

12. The safety light of claim 10, further comprising: at least one light provided within the housing and responsive to the control for backlighting the first face to provide the illuminated indicia.

13. The safety light of claim 10, wherein: the illuminated indicia comprises an image of a firefighter and a child.

14. The safety light of claim 10, wherein: the housing includes a second face, opposite the first face; and the control is responsive to the receiver for providing an illuminated indicia on the second face for informing rescue personnel of the emergency condition when the wireless activation signal is received by the receiver.

15. The safety light of claim 10, further comprising: a switch for detecting tampering with the housing.

16. The safety light of claim 10, further comprising: a switch for detecting that an installation of the housing has been compromised.

17. The safety light of claim 10, wherein: the control and the receiver are provided within the housing.

18. The safety light of claim 10, wherein: the status indicates at least one of a low battery status and loss of power status.

19. The safety light of claim 10, wherein: the status indicates that the housing has been tampered with.

20. The safety light of claim 10, wherein: the status indicates that an installation of the housing has been compromised.

21. An illuminating safety light, comprising:

a housing, the safety light being mountable at a remote location relative to a designated emergency exit;

at least one of a rescue alert light and a directional light for indicating a direction to the designated emergency exit provided within the housing;

a receiver for receiving a wireless activation signal from a transmitter in a home security system when a sensor in the home security system detects an emergency condition;

a transmitter provided within the housing for transmitting a wireless signal to a receiver in the home security system to inform the home security system of a status of the safety light;

wherein the home security system secures a building against burglaries; and a control responsive to the receiver for activating the at least one light when the wireless activation signal is received by the receiver.

22. A directional safety light, comprising:

a housing, including a face;

at least one rescue alert light and at least one directional light for indicating a direction to a designated emergency exit, the safety light being mountable at a remote location relative to the designated emergency exit;

a receiver for receiving a wireless activation signal from a transmitter in a home security system when a sensor in the home security system detects an emergency condition;

a transmitter provided within the housing for transmitting a wireless signal to a receiver in the home security system to inform the home security system of a status of the safety light;

wherein the home security system secures a building against burglaries; and a control responsive to the receiver for providing at least one illuminated directional indicia on the face when the wireless activation signal is received by the receiver.

23. The directional safety light of claim 22, wherein: the at least one directional indicia comprises an arrow to indicate a direction of an exit from the building.

24. The directional safety light of claim 22, wherein: the control provides a plurality of illuminated directional indicia on the face, one at a time, in a time sequence, to indicate a direction of an exit from the building.

25. The directional safety light of claim 22, further comprising: at least one light provided within the housing for backlighting the first face to provide the illuminated indicia.

* * * * *